US006453507B1

(12) United States Patent
Gilbert

(10) Patent No.: US 6,453,507 B1
(45) Date of Patent: Sep. 24, 2002

(54) SELF CONTAINED, SELF-CLEANING, WET/DRY VACUUM MACHINE

(76) Inventor: Gene Wilson Gilbert, 1045 Teatersville Rd., Lancaster, KY (US) 40444

( * ) Notice: Subject to any disclaimer, the term of this patent is extended or adjusted under 35 U.S.C. 154(b) by 0 days.

(21) Appl. No.: 09/523,769

(22) Filed: Mar. 11, 2000

Related U.S. Application Data

(60) Provisional application No. 60/124,689, filed on Mar. 16, 1999.

(51) Int. Cl.[7] ..... A47L 7/00
(52) U.S. Cl. ..... 15/330; 15/321; 15/353
(58) Field of Search ..... 15/330, 353, 321

(56) References Cited

U.S. PATENT DOCUMENTS

| | | | | |
|---|---|---|---|---|
| 3,331,090 A | * | 7/1967 | Reiber et al. | 15/330 X |
| 3,605,786 A | * | 9/1971 | Machin | 15/330 X |
| 4,153,968 A | * | 5/1979 | Perkins | 15/321 |
| 4,171,208 A | * | 10/1979 | Lowder | 15/353 X |
| 4,179,768 A | * | 12/1979 | Sawyer | 15/353 X |
| 4,329,756 A | * | 5/1982 | Chicoine et al. | 15/353 X |
| 4,776,060 A | * | 10/1988 | Chang | 15/353 X |
| 4,841,595 A | * | 6/1989 | Wiese | 15/353 X |
| 5,182,834 A | * | 2/1993 | Wright et al. | 15/330 |
| 5,608,945 A | | 3/1997 | Crouser et al. | |

* cited by examiner

*Primary Examiner*—Chris K. Moore
(74) *Attorney, Agent, or Firm*—Jack Toliver

(57) ABSTRACT

A wet dry cannister vacuum having an upper and lower chamber separated by an intermediate wall. A blower (1) in the upper chamber providing a low and high pressure head communicating with respectively with low and high pressure compartments. A valve (2) opening from the low pressure compartment through the intermediate wall to the lower chamber. Another valve (8) opening from the high pressure compartment through the intermediate wall into the lower chamber. A water reservoir in the bottom of the lower chamber. A duct (15) opens on one end near the bottom of the lower chamber and on the other end to ambient air pressure. In operation, before wet or loose dry material is vacuumed, a small amount of water is introduced into the lower chamber by length of flexible hose being attached to the duct (15) and to a water source on the other. After priming, an attachment for cleaning may be attached to the hose, such as a shampoo wand (25). When refuse water accumulates in the reservoir to a certain level, a float (13) rises to shut off the blower automatically when a predetermined amount has been accumulated. To empty the reservoir, the space above the reservoir in the lower chamber is connected to the high pressure head by reversing the valving in the upper chamber. The duct (15) becomes an discharge pipe pumping out the refuse water to a drain after removing the attachment on the hose.

8 Claims, 3 Drawing Sheets

SELF CONTAINED, SELF-CLEANING, WET/DRY VACUUM MACHINE

PRIOR APPLICATION

This application is based on a prior U.S. provisional patent application, Ser. No. 60/124,689 filed on Mar. 16, 1999.

FIELD OF THE INVENTION

This invention pertains to the field of wet dry vacuums of the cannister type having capabilities for operating in both household and commercial conditions.

BACKGROUND OF THE INVENTION

Wet dry vacuum machines are commonly used around the household for carpet cleaning, and in commercial shops and garages to pick up loose dry material or to clean surfaces using detergent solutions. The commercially available multipurpose vacuums use paper or fibrous filters in the dry mode, and in the wet mode, divert waste water picked up into a holding tank. The filter bag for dry material is emptied when a predetermined accumulation is reached, and in the wet mode, the dirty water is either pump out, or dumped by removing the tank and pouring the contents down a drain. Power is lost in either mode due to baffles and air/water resistance requiring larger blowers. A separate motor is used for pumping out the reservoir and usual objections to handling a dry filtering system exist with such vacuums. Using separate wet/dry tanks adds to the cost, and bulk. When the wet tank is full, and emptying the dirty water is a chore. A wet dry vacuum of this type is disclosed in U.S. Pat. No. 5,608,945 issued Mar. 11, 1997, assigned to the Hoover Company of North Canton, Ohio, USA.

SUMMARY OF THE PRESENT INVENTION

In the present invention, a wet dry vacuum is provided that has no filters to clean or replace, and uses one tank for both wet and dry operations. One motor powers a blower that provides all the necessary suction. A unique feature is that a valving and baffle system is employed that uses the pressure differential created by the blower both for wet or dry suction, but alternatively as a pneumatic pump, where the high pressure side of the blower is used to pump out the tank, or flush it by alternately sucking up a small amount of water, and switching to the pressure mode to empty it using the same air/water ducts and hoses.

The cannister is self-contained and self-cleaning. In the shampoo mode, a wand with a shampooing head is attached to a flexible hose connected to the vacuum port of the cannister. The wand has a clean water and detergent line running to a spray nozzle in the shampooing head. The flexible hose transports the dirty water sucked up from the surface being cleaned into the tank or refuse compartment of the cannister. A float assembly automatically shuts off the motor when a predetermined maximum water level is reached to prevent overflow during any wet operation. When the maximum water level is reached, the hose becomes a discharge pipe for the dirty water. The controls are switched to the "empty " position and automatically, the waste water is pumped out into a drain, without having to disassembly of the unit.

An object of the invention is to provide a self-contained wet dry vacuum that does not require filters or separate tanks, and is self-cleaning in either the wet or dry mode.

Another object is to provide a shampooer that siphons a metered quantity of detergent to a cleaning head that simultaneously picks up the waste water and deposits it in a refuse chamber. When filled, or periodically as desired, the refuse chamber is emptied by pumping out the water into a drain using the same ducts and flexible hose.

Another object is that a self-flush action relieves the user from having to, empty the tank by hand, in either the wet or dry mode, by merely sucking up a quantity of clean water and pumping it out, repeating the operation until the refuse chamber is purged.

Still another object is to avoid the need for separate tanks for wet and dry operations, and provide a self-contained, self-cleaning dual action vacuum that uses one blower and valving that can be switch between wet and dry modes at any time.

Another object is to provide a wet vacuum having a float actuated switch to automatically shut off the unit to prevent overfill.

Another object is to provide a pressure washer to hose down surfaces, or by reversing the valving, alternate between a washing and vacuuming.

Another object is to provide a portable sump pump for wet basements, fish tanks, and the like, or as a plumbing aid in clearing a clogged drain.

As a shampooer, the tank is emptied periodically using the same hose as used for picking up the waste water, and a float protects against accidental overfill.

These and other objects will be more apparent by reference to the following detailed description of a preferred embodiment of the invention.

DETAILED DESCRIPTION OF THE INVENTION

Figure 1:
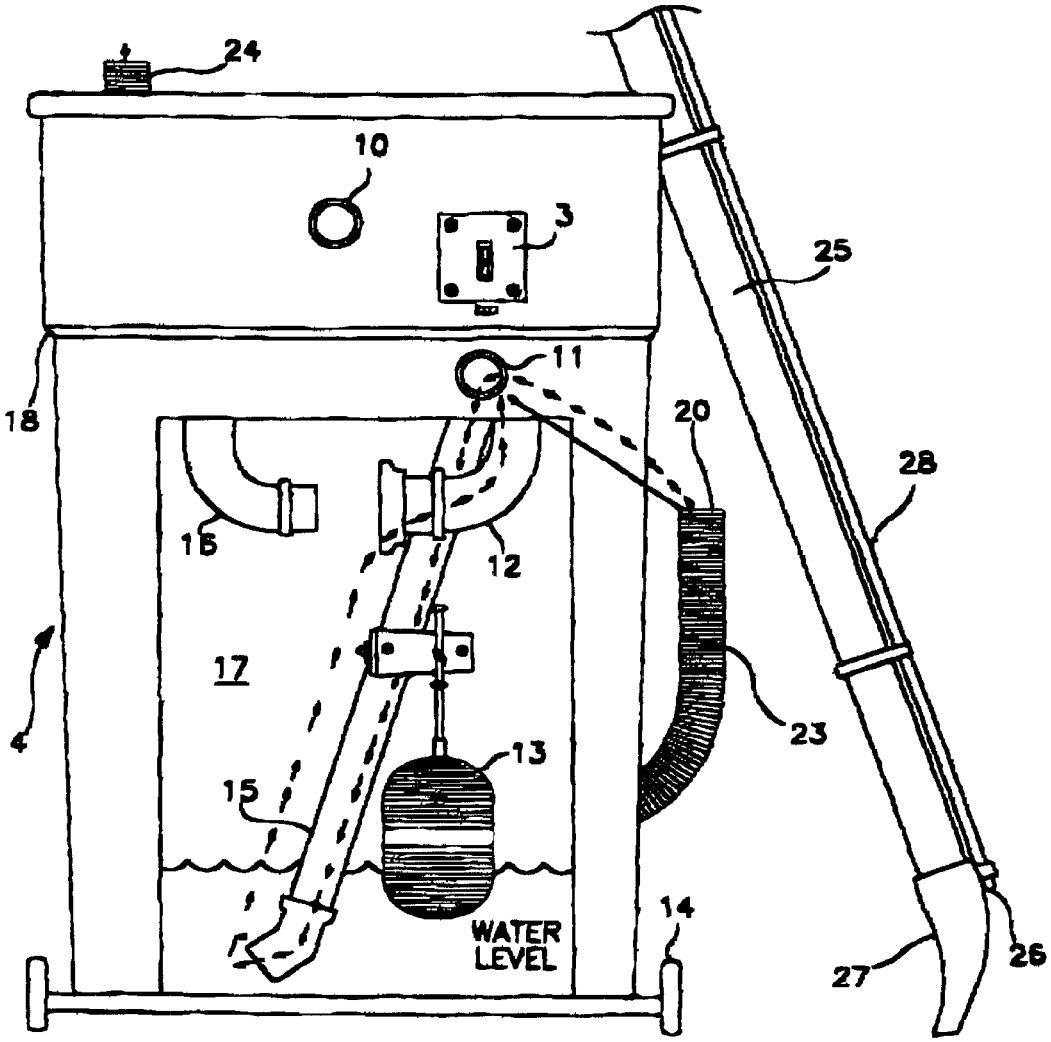
FIG. 1 depicts a portable wet dry vacuum. A portion of the lower chamber wall is broken away to show the water reservoir, float assembly and duct work. A shampoo wand with a removable flexible hose, shown in partial view, is attached to the lower chamber, a different wand and head accessory would be used in the dry vacuum mode. Directional arrows depict the air/water flow.
Figure 2:
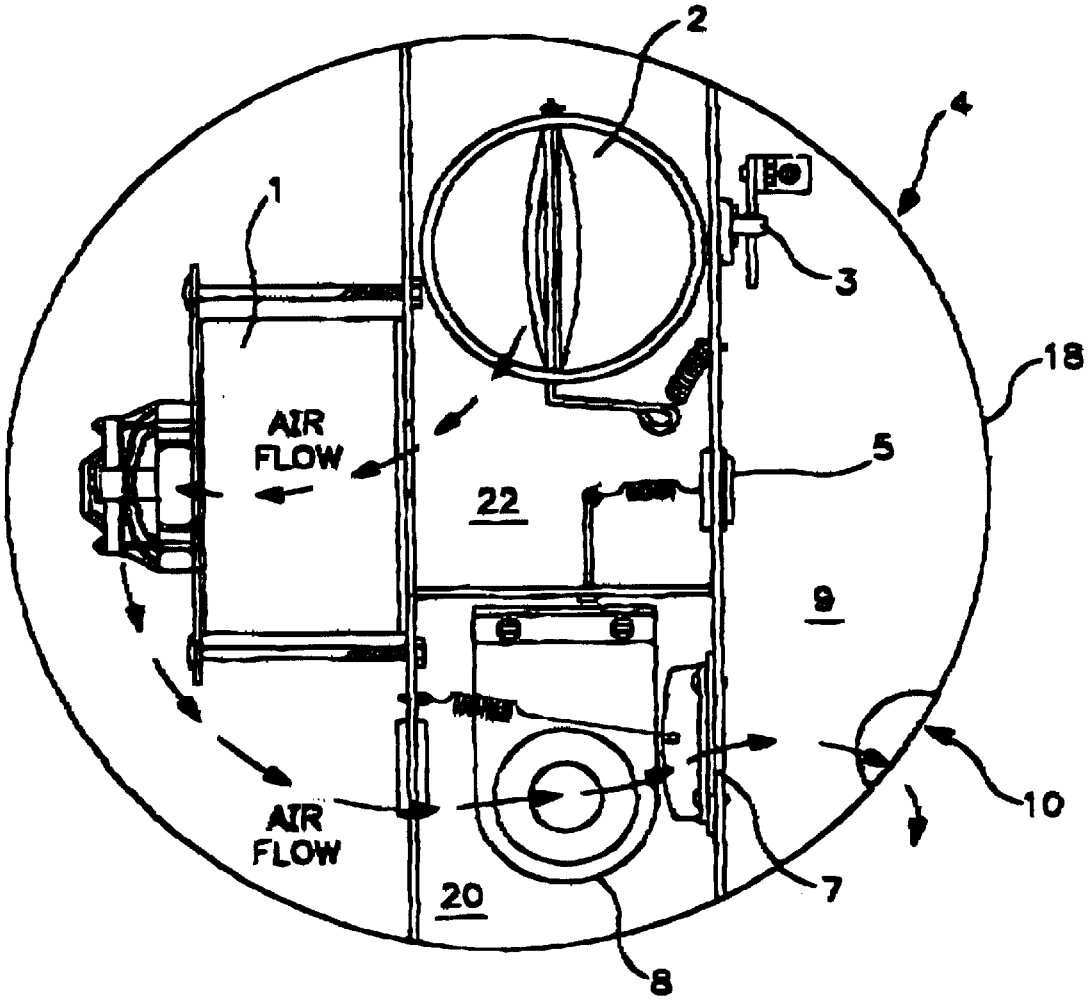
FIG. 2 is a plan view of the cannister in FIG. 1 with the lid covering the upper chamber removed showing a valve system, set in the vacuum mode, with air being drawn from the lower chamber, illustrated as a continuation of the directional arrows from the lower chamber in FIG. 1.

Referring to FIGS. 1 and 2, a motor and blower unit (1) in FIG. 2 provides a vacuum source. A butterfly valve (2) is in either the open or closed position, depending on whether the unit is being operated in the vacuum or pressure modes. In FIG. 2, it is shown spring biased in the open vacuum position. A power switch (3) has "on" and "off" positions for controlling the motor and blower unit (1). An air exhaust valve (7) is normally open in the vacuum mode, and works in tandem with the butterfly valve (2) to open or close, depending on the position of the butterfly valve. Air escapes or enters through a port (10) in the cannister upper chamber wall. A flap valve (8) is normally closed in the vacuum mode, as depicted in FIG. 2, when the butterfly valve (2) is open, and is biased open in the pressure mode, when the butterfly valve (2) is closed. It works in tandem with an air valve (5) which is normally closed, in the vacuum mode, and biased open is the pressure mode. When one set of valves is open (2) and (7) in the vacuum mode, the other set (5) and (8) is closed and vice versa in the pressure mode.

Figure 4:
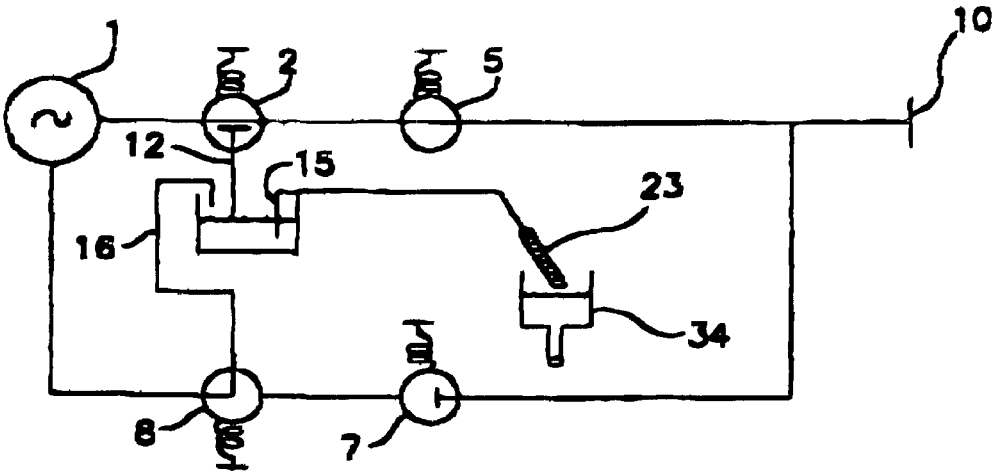
FIG. 4 is a schematic diagram of the valve system set in the pressure mode.
Figure 4A:
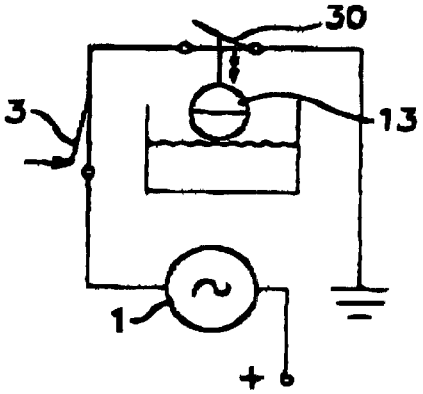
FIG. 4A is a schematic of the overfill shut off electrical circuit.

The vacuum cannister (4) shown in FIG. 1 may be made easy to move by having casters or rollers (14) supporting it. Structurally, the cannister has an upper chamber (9) separated from a lower chamber (17) by an intermediate wall (18). The upper chamber (9) as shown in FIG. 2 has high and low pressure air compartments (20) and (22) defined on the bottom by the intermediate wall (18). on the sides by vertical walls, and on top by a cover (not shown) of the cannister. High pressure compartment (20) is adjacent low pressure compartment (22) as determined by the side of the blower they are on in terms of its pressure head. The low pressure compartment (22) communicates through the butterfly valve (2) with a duct (12) opening into the lower chamber, as shown in FIG. 1, above a maximum water level, as determined by a float (13), depicted at the initial water level, in the bottom of the lower chamber (17). The float (13) as shown in FIG. 4 A, rises to open a switch (30), normally closed, in the electrical circuit with the power switch (3) providing an overfill safety switch circuit interrupting electrical power to the motor and blower unit (1) if the water level reaches a predetermined maximum level before being emptied out. The flap valve (8) in high pressure compartment (20) communicates with a duct (16) opening in the lower chamber above the maximum water level.

Figure 3:
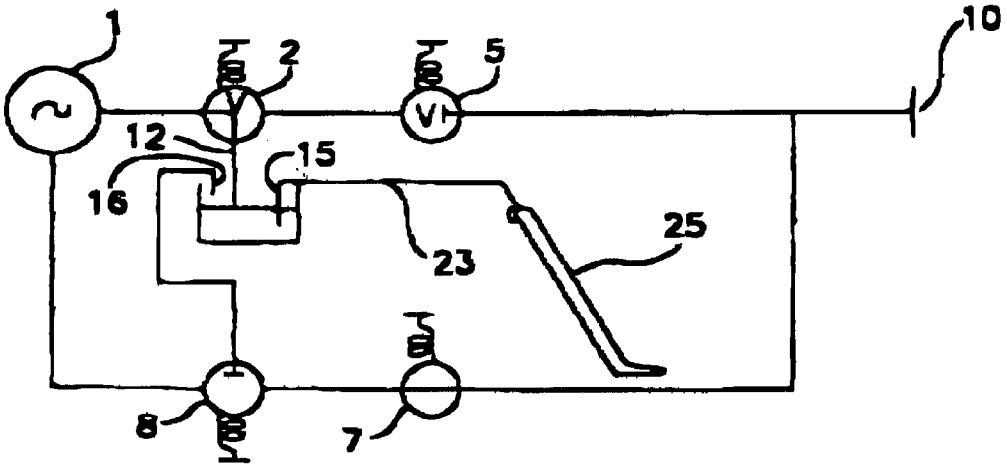
FIG. 3 is a schematic diagram of the valve system set in the vacuum mode.

As shown in FIGS. 3, the valves (2) and (7) are open in the vacuum mode so that the low pressure side of the blower (1), through compartment (22), communicates with the duct (12). In FIG. 1, a flexible hose (23) is attached on one end (20) to a port (11). It opens into the lower chamber (17) through a duct (15) which extends down nearly to the bottom opening below the initial water level in the lower chanber. A shampoo wand (25) is depicted partially broken away, but its upper end would have a quick disconnect coupling with the other end (24) of the hose (23). A suction head (27) is attachable to the lower end of the wand (25) to suction up the dirty water. A spray nozzle (26) is attached to a water/detergent line (28) which delivers a spray mixture of cleaning fluid and water. The cleaning fluid concentrate may be aspirated from a venturi bottle (not shown) connected to a water pressure source, such as any household water faucet. A water mixture in proportion to the water pressure and venturi bottle's calibration will determine the proper amount of cleaning fluid being aspirated. The directional arrows show the movement of air/dirty water mixture in the vacuum mode. As the dirty water is picked up by the head (27) and transported to the lower chamber (17), it is deposited by the duct (15) in the reservoir raising the initial water level. Clean air only, now separated from dirty water, leaves through duct (12) where it enters the upper compartment (22) and, since valve (8) is closed, it is exhausted through valve (7) to the air inlet/exhaust port (10).

In the pressure mode, referring to FIG. 4, the valve positions are reversed. The flap valve (8) is now open to communicate the high pressure side of the blower through compartment (22) with the duct (16). This pressurizes the lower chamber. The only way out for the water in the reservoir is up through the duct (15). The hose (23) has now been disconnected from the wand (25) and it is taken to any household drain (34) where the dirty water is pumped. The valves (2) and (7) are closed, but valve (5) is open taking in fresh air from port (10) and with valve (8) now open, air under pressure is delivered to the duct (16) pressurizing the air tight lower chamber. It will be appreciated that the valves maybe operated by any electrical or mechanical system, such as by servo motors, or by cables manually controlled from the outside. The invention is described in use as a shampooer, however, it may be used as a dry vacuum. Instead of the shampoo wand, a vacuum wand may be attached to the hose (23). The reservoir will be initially charged with clean water by suctioning up an amount from a bucket, or other source, to a level above the lower end of the duct (15). As the dirt and air pass through the water, the dirt is separated out, and the clean air is exhausted through duct (12) and port (10). While the initial charge is preferably water, the liquid medium may be other than water for an application in which water is not a suitable "filter" for the fluid being purified. The refuse and water in the bottom is periodically "dumped " by putting the unit in the pressure mode (FIG. 4) and discharging the reservoir into the drain (34). The lower chamber may be washed out by repeatedly suctioning up a quantity of clean water and discharging it until the reservoir, ducts, and hose are clean again. Or the unit may be used as a sump punp, periodically emptying the reservoir by pumping out the accumulation. As a pressure washer, a washing wand can be attached. Clean water initially charged to a level permitted by the float (13) that is, to a level short of interrupting power, will be delivered under pressure to aspirate a soap solution and a spray nozzle applies the mixture to wash cars, house siding, roofs, decks and for other cleaning chores. Liquid chemicals can be applied to any surface in bulk by charging the reservoir with them. Any surface can be vacuumed wet or dry.

The invention has been described with reference to a preferred embodiment, however it will be appreciated that various modifications may be made without departing form the scope of the invention as defined by the appended claims.

I claim:

1. A cannister comprising:

a chamber divided into upper and lower portions having a reservoir and an air space above the reservoir in said lower portion and a pair of compartments communicating with the lower portion, but not with each other, in the upper portion, a blower providing a source of low and high pressure communicating with said pair of compartments such that one is a negative pressure compartment and the other is a positive pressure compartment, either selectively adapted to be connected to said air space in the lower portion of the chamber to create either a high or a low pressure head therein, valve means in each of said compartments for selecting one or the other to be connected to the air space above the reservoir, a liquid medium in said reservoir having a first depth corresponding to an initial volume of air space above it exposed to the low pressure head when said negative pressure compartment is caused to communicate by the valve means with said lower portion, and a second depth corresponding to a final volume of air space exposed to the high pressure head when said positive pressure compartment is selected by said valve means to communicate with said lower portion, and tubular means having one end opening in said reservoir below the first depth and substantially coextensive with the second depth of the liquid medium, and an opposite end extending above the first depth of the liquid medium from the lower portion and an imperforate portion extending between the two ends, said tubular means opposite end being accessible from the exterior of the cannister for conducting wet or dry material to and wet material from the reservoir solely from said one end.

2. A cannister as set forth in claim 1 wherein a first duct extends from the negative pressure compartment into the lower portion, and a second duct extends from the positive pressure compartment into the lower portion, said first duct being open into the air space above the liquid medium when the second duct is closed in the vacuum mode, and vice versa in the pressure mode as selectively determined by said valve means.

3. A cannister as set forth in claim 1 wherein the said imperforate tubular means includes a fixed duct having a lower end near the bottom of the reservoir, and an upper end opening from said lower portion to the exterior of the cannister above the liquid medium, and a hose is attachable to the upper end of the duct for conducting material to or away from the reservoir depending on which compartment is communicating with the air space above it, the material conducted to the reservoir being vacuumed up from outside the cannister in either a wet or dry condition, and the material conducted away from the reservoir being the contaminated liquid medium in the reservoir containing the debris separated out from the vacuumed up material.

4. A cannister as set forth in claim 1 comprising in addition:

float means operable when the liquid medium level reaches a predetermined height within the reservoir to cause power to be shut off to the blower and interrupt delivery of low or high pressure to the pair of compartments in the upper portion of the cannister.

5. A cannister adapted to be connected to a flexible hose for vacuuming up wet/dry materials comprising:

a housing having an upper chamber, an intermediate dividing wall, and a lower chamber, a blower unit providing a source of negative and positive air pressure to the upper chamber, a pair of compartments in the upper chamber, each having an opening into the lower chamber through the intermediate dividing wall, one communicating with the negative pressure and the other with the positive pressure delivered by said blower unit, valve means operable to close one of said openings and open the other of the respective compartments, alternatively to communicate the negative or positive air pressure to the lower chamber, a quantity of liquid contained within the lower chamber at the start of either wet or dry operation to a depth above the bottom of the lower chamber sufficient to act as a filtration medium, and an imperforate duct opening on one end near the bottom of the lower chamber below the upper surface of said quantity of liquid and connected on the other end to said flexible hose, whereby the debris in the wet or dry material vacuumed up in the negative pressure mode of operation is absorbed in said quantity of liquid and expelled with it later in the positive pressure mode of operation.

6. A cannister as set forth in claim 5 comprising in addition:

an electrical power circuit, a motor connected to the power circuit for operating said blower unit to create the negative and positive air pressure in said respective compartments, and float means rising with the level of said quantity of liquid above a predetermined level to interrupt said power circuit.

7. A cannister as set forth in claim 6 wherein the quantity of liquid initially received in the lower chamber is clean water.

8. A cannister as set forth in claim 7 comprising in addition:

a tubular wand having one end attachable to said hose and an opposite end to a suction head for vacuuming up wet/dry material.

* * * * *